United States Patent [19]

Stiegler et al.

[11] 4,384,411

[45] May 24, 1983

[54] PORTABLE HAIR DRYER

[75] Inventors: Alex Stiegler, Schwalbach; Heinrich Möller, Bad Soden; Hubert Giraud, Neu Isenburg; Karl-Heinz Hoffmann, Schmitten; Robert Oberheim, Liederbach, all of Fed. Rep. of Germany

[73] Assignee: Braun Aktiengesellschaft, Kronberg, Fed. Rep. of Germany

[21] Appl. No.: 288,578

[22] Filed: Jul. 30, 1981

[30] Foreign Application Priority Data

Aug. 16, 1980 [DE] Fed. Rep. of Germany ..... 3031110

[51] Int. Cl.[3] ..... A45D 20/22

[52] U.S. Cl. ..... 34/99; 34/230

[58] Field of Search ..... 34/99, 100, 223, 230; 219/369, 372; 132/7, 9

[56] References Cited

U.S. PATENT DOCUMENTS

| | | | |
|---|---|---|---|
| 3,727,321 | 4/1972 | Waters et al. | 34/99 |
| 4,038,759 | 8/1977 | Dyer et al. | 34/99 |

FOREIGN PATENT DOCUMENTS

| | | | |
|---|---|---|---|
| 1833320 | 6/1961 | Fed. Rep. of Germany . | |
| 2308011 | 8/1974 | Fed. Rep. of Germany . | |
| 7419321 | 12/1975 | Fed. Rep. of Germany . | |
| 2810766 | 9/1979 | Fed. Rep. of Germany | 34/99 |
| 2420182 | 4/1974 | U.S.S.R. | 34/99 |

*Primary Examiner*—Larry I. Schwartz

*Attorney, Agent, or Firm*—Raymond J. De Villis

[57] ABSTRACT

A flexible bonnet portable hair dryer including two separate combination blower and heater units. A flexible U-shaped collar support is connected to the combination blower and heater units and to a lower edge of the bonnet.

5 Claims, 3 Drawing Figures

PORTABLE HAIR DRYER

BACKGROUND OF THE INVENTION

This invention relates to a freely portable bonnet hair dryer. More particularly, this invention relates to a bonnet hair dryer having two separate air channels and a plurality of interior air outlets. The hair dryer is made of a foldable material, and is equipped with an electrical device for blowing warm air. The electrical device is connected to the interior of the bonnet through a hose device.

U.S. Pat. No. 3,727,321 discloses a freely portable hair-drying bonnet in which a bonnet part is located underneath a warm air blower. The bonnet part consists of a double-walled and foldable foil material that is equipped with air channels and interior air outlets. The hot air blower is relatively heavy compared to the bonnet part. The hot air blower therefore has an unstable position at the uppermost point of the bonnet part that is set on the head of the person being treated. This causes a relatively unsafe, unstable seating of the bonnet part, i.e. the hair-drying bonnet tends to slide.

Another freely portable hair-drying bonnet is disclosed in DE-GM No. 18 33 320 in which the bonnet part is connected to a warm air blower through hose-shaped extensions that hang down on both sides of the head. This drying bonnet has the disadvantage that the entire weight of the warm air blower is applied to the hose-shaped extensions. This is uncomfortable for the person carrying this device, especially since the bonnet part is blown up into different shapes for different head sizes, so that the bonnet part may slide so far down that the eyes of the person carrying it are covered.

With a similar known hair-drying bonnet dislosed in DE-OS No. 23 08 011, a warm air blower is equipped with a carrying device and hangs around the neck of the user in the fashion of a locket. The warm air blower is connected to hose-like flexible air-conducting bodies. Because of the compressed air that flows out of the blower, through interior air outlets, into the bonnet, the bonnet part can float on the head of the person being treated. Use of this hair drying bonnet is relatively complicated, since, before the floating bonnet is put on, the carrying strap must first be pulled through the hairdo, which is generally bulky because of hair curlers and the like.

Finally, a drying bonnet is disclosed in DE-GM No. 74 19 321, in which the bonnet part consists of a foldable material which is directly connected to a single electrical warm air blower than can be activated by a hand switch. Here, the warm air blower and the hand switch are situated in a U-shaped collar that forms the lower edge of the bonnet part. The collar itself is designed as a dimensionally stable, tubular air-conducting body, which is at least partly supported on the neck of the person carrying it. This drying bonnet has the disadvantage that the dimensionally stable air-conducting body often presses on the neck if the person carrying it because, as a consequence of its rigidity, it cannot adapt to the shape of the neck. Furthermore, such a drying bonnet is difficult to pack for storage purposes.

The prior art difficulties and disadvantages have been substantially overcome by providing a portable hair dryer comprising a flexible bonnet and two blower and heater power modules for supplying heated air under pressure to the bonnet. A flexible collar member, which conforms to the neck and shoulder of the user, is connected to the power modules and releasably connected to the bonnet.

SUMMARY OF THE INVENTION

The present invention is therefore based on the aim of designing a freely portable hair-drying bonnet so that its use and operation is as simple and comfortable as possible, whose bonnet part has an optimum supply of warm air, whose bonnet part is blown up as much as possible in the same manner for every shape and size of head, and which can easily be stored in a small space.

Briefly stated and according to an aspect of this invention, this aim is achieved by providing a warm air blower at the end of a flexible collar section, on each side of the temple area. The collar section, which is connected to a lower edge of the bonnet part, is approximately U-shaped and supported on the neck and shoulders of the user. Each of the warm air blowers is connected to the bonnet part through its own hose line.

The collar section and/or the lower edge of the bonnet part preferably have extensions shaped like tabs or fingers, which extend approximately vertically, through which the collar section and the lower edge of the bonnet part can be connected together.

It is advantageous to connect the first of the two blower units with a power supply cable, while the second blower unit is connected through a cable to the first blower unit. The cable is retained and guided along the collar section and/or is welded, cast, or clipped onto it.

So that the bonnet part can easily be interchanged, a preferred embodiment provides the bonnet part with finger-shaped tabs, which can be tied or riveted onto the collar section.

For making repairs on the blower units, it is advantageous for the two blower units to form a unit together with the power supply cables and the collar section, where the unit can be removed from the bonnet part. Since the collar section has a cable, which connects the two blower units together, the ends of the collar section are suitably designed as electrical plug connections, through which the collar section can be connected with the blower units.

In addition to the plug connections, the ends of the collar section can also be equipped with bayonette locks, snap fasteners, or the like, which afford an especially stable connection of the collar section to the blower units.

In order to make carrying of the unit feel comfortable, a preferred embodiment provides that the collar section is equipped with a cushion support at its lower side.

An especially good seating of the drying bonnet on the shoulders and in the neck area of the person carrying it is achieved by designing the blank for the collar section strip-shaped and by its having the form of a circular arc. The inner radius of curvature of the blank is about 250 mm, so that, in the position in which it is actually used, the center section of the collar section is set approximately vertically.

BRIEF DESCRIPTION OF THE DRAWINGS

The invention both as to its organization and principle of operation, together with further objects and advantages thereof, may better be understood by reference to the following detailed description of an embodiment of the invention taken in conjunction with the accompanying drawing in which.

DETAILED DESCRIPTION

Figure 1:
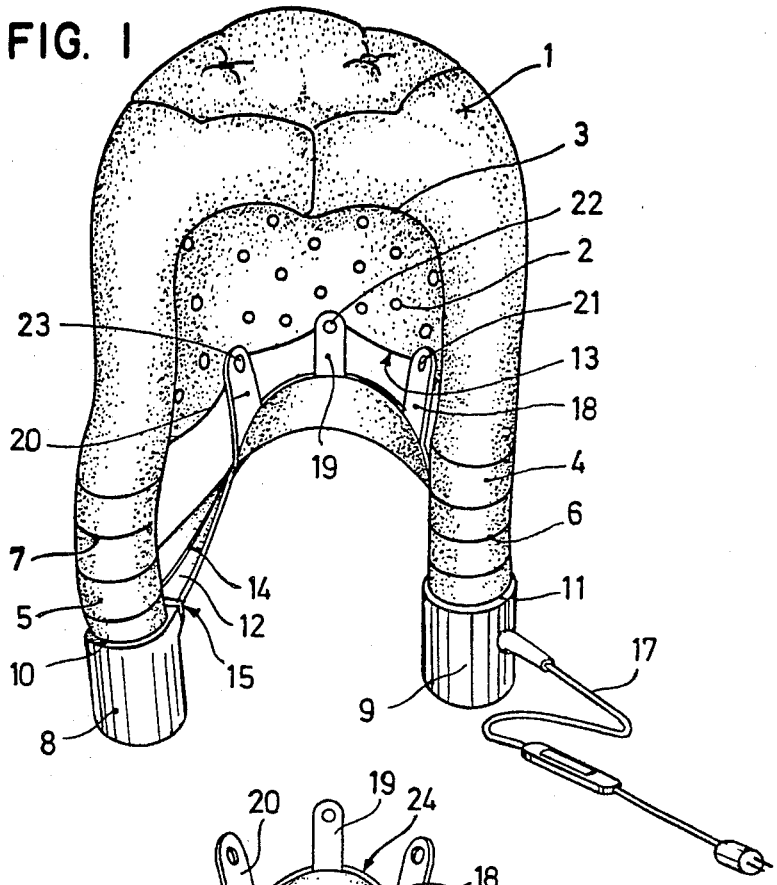
FIG. 1 is a perspective view of a drying bonnet according to the present invention.
Figure 2:
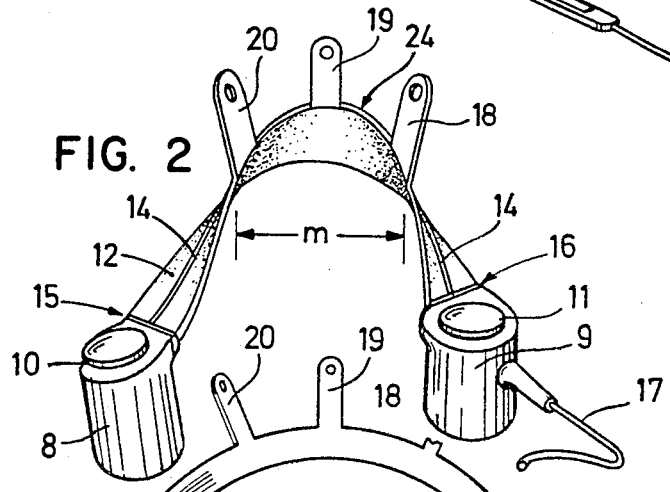
FIG. 2 is a perspective view of the two blower units and the collar section of FIG. 1, in accordance with this invention.

A drying bonnet consists of a double-walled bonnet section 1, which is made of a flexible material. In order to assure the most uniform and rapid air throughflow possible, the bonnet section 1 is equipped with hose lines 4 and 5 which hang downwards and are situated on both sides of the face cut-out portion 3. Through hose lines 4 and 5, warm air is conveyed into the interior of the bonnet section 1. The warm air thereby distributes itself in the interior of the bonnet section 1 and exits uniformly from a large number of openings 2 in a direction toward the hair that is supposed to be dried.

The hose lines 4 and 5 are reinforced with a spiral-wound wire 6 and 7 respectively which assures that the full cross section of the hose lines 4 and 5 is available for blowing in the warm air, even if the hose lines accidentally do not hang down correctly and freely after the drying bonnet is put on.

The hose lines 4 and 5 are connected to warm air blowers 8 and 9. Quick-action couplings 10 and 11 are provided between the ends of the hose lines 4 and 5 respectively and the exhaust openings of the warm air blowers 8 and 9.

Warm air blowers 8 and 9 are connected together through a collar section 12. The collar section 12 is connected to a lower edge 13 of the bonnet section 1 through finger-like tabs or clips 18, 19, and 20.

The collar section 12 is equipped with an electrical connection line 14, which goes into plug connectors 15 and 16, which in turn are plugged into the warm air blowers 8 and 9. The blower unit 9 is connected with an electrical feeder cable 17, which supplies electrical power to the warm air blower 9 and, through the route of the connecting line 14, to the blower 8.

If it should become necessary to replace the bonnet section 1 or to repair one of the warm air blowers 8 and 9, the quick-action couplings at 10 and 11 can be loosened and the warm air blowers 8 and 9 can be pulled off from the plug connectors 15 and 16 respectively. Likewise, it is possible to separate the clips 18, 19, and 20 from the lower edge 13 of the bonnet section 1, since these clips are fastened with snap fasteners 21, 22, and 23 in the area of the lower edge of the bonnet.

Apart from the advantage that the main subunits of the drying bonnet, namely the warm air blowers 8 and 9, the bonnet section 1 with its hose lines 4 and 5, the collar section 12 with the electrical connection line 14, the plug connectors 15 and 16 and the electrical power supply cable 17, can be separated from one another, the drying bonnet described above has the additional advantage of being able to dry the hair in a comparatively short time. A warm air blower is provided at each temple area of the user of the bonnet, and consequently the dry air streams into the bonnet section 1 simultaneously from both sides. It is therefore easy for the air to distribute itself uniformly in the interior of the bonnet. This assures that dry warm air, in suitable amounts and with uniform velocity, emerges from all the air exit openings 2.

Because the flexible drying bonnet is equipped with two warm air blowers 8 and 9, the two units can be designed so that their blowers and motors operate at comparatively low speed, and consequently their running noise and blower noises are comparatively low.

Finally, the drying bonnet can easily be placed on the head by the user thereof since, for example, no unit or cabling or hose line is provided on the chest, which might impede the putting on of the bonnet. The warm air blowers are located at the level of the collar bones of the person carrying them. Their weight is therefore intercepted by the collar section 12, which is designed relatively wide, and is made up of flexible material. The collar section is shaped so that it lies flat against the neck and shoulders of the person carrying it.

Figure 3:
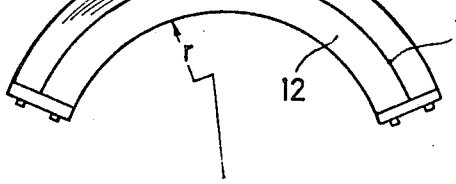
FIG. 3 is a top view of the blank for the collar section of FIG. 1, in accordance with this invention.

As is shown in FIG. 3, the blank for the collar section 12 is designed in strip-shape, whereby the strip has the form of a circular arc. The inner radius of curvature r of the strip-shape blank is dimensioned so that, when the two warm air blower units, which are connectible with the ends of the collar section 12, are in their actual use position, i.e. when the collar section is wrapped around the neck of the person carrying it, they deform the blank in such a fashion that the middle section m sets up approximately vertically. The two end sections (on both sides of the section m), on the other hand, lie flat against the front side of the torso. Therefore, the middle section m of the collar section twists by about 90° with respect to the end sections when the unit is in its use position.

It is clear that, in a simplified embodiment, the collar section 12 can also be designed as one unit with the housings of the blowers. In such a case, the collar section 12 is fabricated of a flexible plastic and is welded or glued together with the housing sections of the blower units 8 and 9. In place of finger-shaped clips 18, 19, and 20, the upper edge 24 of the collar section 12 can also be directly tied, clipped, or otherwise connected with the lower edge 13 of the bonnet section 1. In place of plug connectors 15 and 16, straightening connections, snap fasteners, or the like can also be provided, so as to make a loosenable connection between the collar section 12 and the blower units 8 and 9.

While an embodiment and application of the invention have been shown and described, it will be apparent to those skilled in the art that many more modifications are possible without departing from the inventive concepts herein described.

The invention, therefore, is not to be described except as is necessary by the prior art and the spirit of the appended claims.

What is claimed as new and desired to be secured by Letters Patent of the United States is:

1. A portable hair dryer comprising:

a flexible bonnet adapted to fit over the head of a user for distributing air onto a hair surface to be dried, said bonnet having first and second separate air-conducting inlet channels for receiving heated air under pressure and a plurality of interior air outlets proximate to the hair surface;

first and second separate combination blower and heater units for providing heated air under pressure, connected to said first and second separate air-conducting inlet channels respectively;

means for applying power to said first and second separate combination blower and heating units;

a flexible, approximately U-shaped support member, having first and second free ends and a plurality of upstanding tabs, and supportable against the neck and shoulder of the user, connected to said first and second separate combination blower and heater units at said first and second free ends respectively; and connecting means, including readily releasable members, for connecting a portion of said support member to a portion of said bonnet, said readily releasable members including fasteners positioned proximate a lower edge of said bonnet, wherein said tabs of said support member cooperate with said fasteners.

2. The hair dryer as in claim 1 wherein said fasteners are snap fasteners.

3. The hair dryer as in claim 2 wherein said first and second blowing and heating units are connected to said first and second air inlet channels through quick-action hose couplings and wherein said means for applying power includes a power supply cable, and said cable, first and second blower and heater units and said support member form a single member separable from said bonnet through said quick-action hose couplings and said snap fasteners.

4. The hair dryer as in claim 3 wherein said support member includes a cushion support.

5. The hair dryer as in claim 1 wherein said support member is formed in strip-shape in a circular arc, whereby the inner radius of curvature is approximately 250 mm so that a center section of said support member adapted to be supported against the neck of the user is upstanding.

* * * * *